US006543649B1

(12) United States Patent
Danielo et al.

(10) Patent No.: US 6,543,649 B1
(45) Date of Patent: Apr. 8, 2003

(54) CHILD-RESISTANT LIQUID DISPENSER

(75) Inventors: Francois Danielo, Hacienda Heights, CA (US); Lluis Costa, West Covina, CA (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 10/120,375

(22) Filed: Apr. 12, 2002

(51) Int. Cl.[7] ..... B67D 5/33
(52) U.S. Cl. ..... 222/153.13; 222/384; 222/321.9
(58) Field of Search ..... 222/153.13, 321.7, 222/321.9, 384

(56) References Cited

U.S. PATENT DOCUMENTS 4,384,660 A * 5/1983 Palmisano et al. ..... 222/153.07
4,441,633 A * 4/1984 Bennett ..... 222/153.13
4,479,589 A * 10/1984 Ford ..... 222/153.13
5,738,250 A 4/1998 Gillingham et al. ... 222/153.13
5,975,370 A * 11/1999 Durliat ..... 222/153.06

* cited by examiner

*Primary Examiner*—David A. Scherbel
*Assistant Examiner*—Stephanie Willatt
(74) *Attorney, Agent, or Firm*—Dykema Gossett PLLC

(57) ABSTRACT

A liquid pump dispenser with a discharge spout is rendered child-resistant by the provision of a hollow sleeve surrounding the pump body and engaging an upper wall of the closure cap with at least one lip at an upper end of the sleeve engaging an underside of the plunger head to immobilize the head against actuation. The sleeve is removed prior to dispensing as the lip is pulled or forced away from the head permitting upward movement of the sleeve in a direction rotatable about the head as the spout extends through a cutout in the sleeve whereafter the sleeve is slid along the spout and completely removed.

12 Claims, 2 Drawing Sheets

FIG. 5
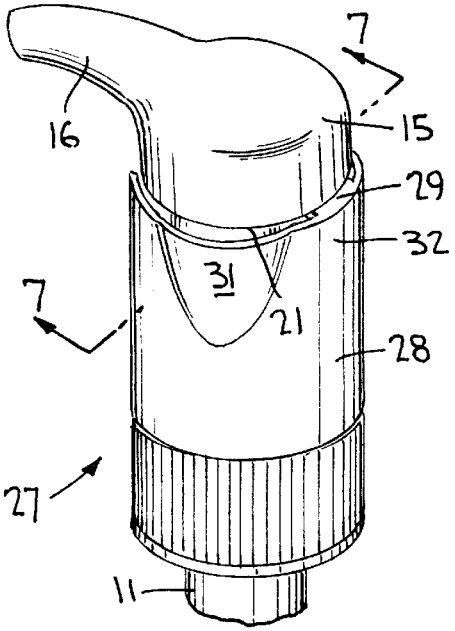
FIG. 6
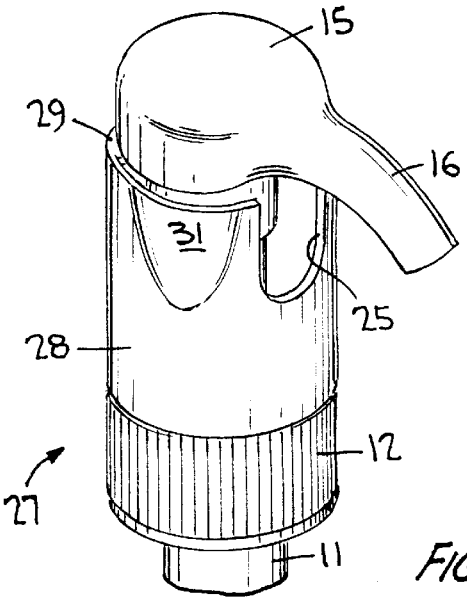
FIG. 11
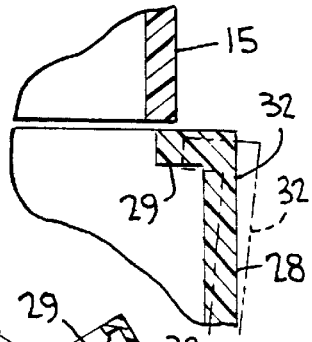
FIG. 9
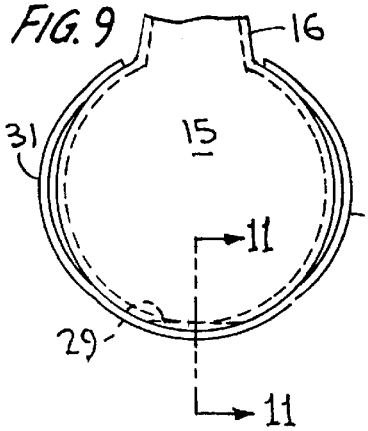
FIG. 10
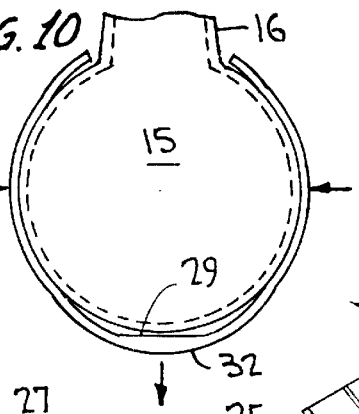
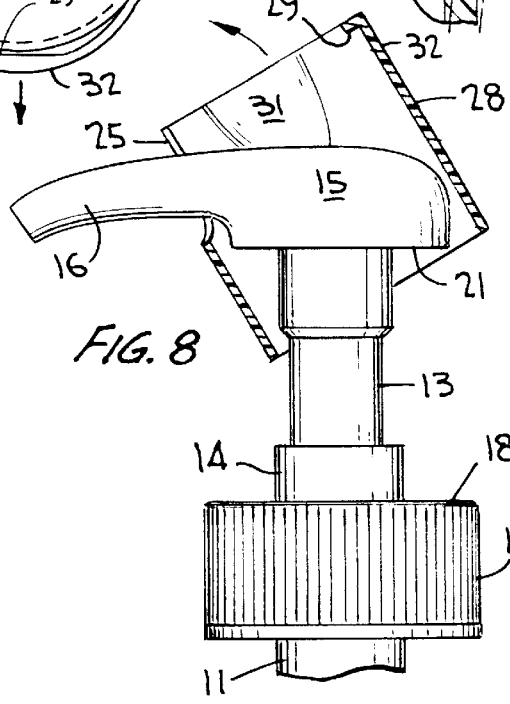
FIG. 8
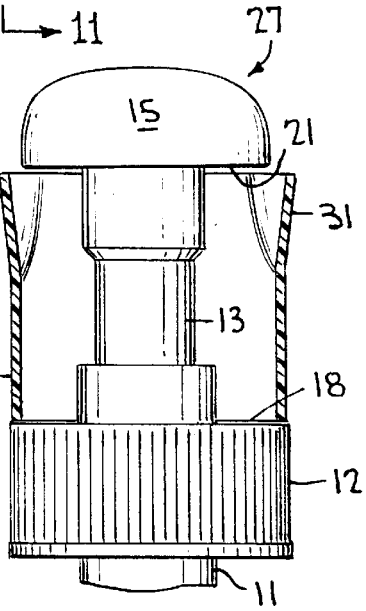
FIG. 7

CHILD-RESISTANT LIQUID DISPENSER

BACKGROUND OF THE INVENTION

This invention relates to a liquid pump dispenser having a manually reciprocable pump plunger with a transversely extending discharge spout, and more particularly to such a dispenser having a removable child-resistant feature immobilizing plunger actuation unless removed.

Various types of child-resistant features for manual dispensers have been devised for locking the pump plunger in either an up position or a down position relative to the closure cap to which it is connected. Typically two or more disparate movements are required to incapacitate a child from unlocking or opening a liquid dispenser. Although the child is thwarted, the prior art child-resistant measures developed render the release operation to facilitate operation sometimes too complicated and confusing for the adult. Many such prior art attempts require tear strips or breakaways along weakened lines for release which are made difficult for some adults.

Moreover, most prior art child-resistant measures require special molds for the pump parts which must be specially designed requiring new machinery and molds rendering the dispenser more costly to produce, and more labor intensive to manufacture and assemble.

SUMMARY OF THE INVENTION

It is therefore an object of the present invention to provide a child-resistant feature for existing pump dispensers having a discharge spout, without the need for the redesign of any pump part yet positively precludes opening by a child of tender years. The child-resistant feature according to the invention is designed to thwart pump operation by a child yet is uncomplicated and readily manipulable by an adult for readying the pump for actuation when desired.

In accordance with the invention a sleeve surrounding the plunger stem engages the top wall of the closure cap to which the pump is attached, and has a lip engaging an underside of the plunger head to prevent plunger actuation. The lip is connected to the sleeve for manual release from the underside of the head, and the spout extends through an upper opening in the sleeve in the process of sleeve removal.

The lip can be connected to a resilient flap formed in the wall of the sleeve and a pull tab on the flap is provided for manually releasing the lip. Otherwise the sleeve may be oval shaped at its upper end with opposing portions of the wall of the sleeve extending outwardly of the head such that when pressed together the lip is released from the head.

Other objects, advantages, and novel features of the invention will become more apparent from the following detailed description of the invention when taken in conjunction with the accompanying drawings.

BRIEF DESCRIPTION OF THE DRAWINGS

FIG. 5 is a perspective rear view of the pump dispenser incorporating another embodiment of the child-resistant feature of the invention;

FIG. 6 is a perspective front view of FIG. 5;

FIG. 7 shows the sleeve in vertical section as taken along the line 7—7 of FIG. 5;

FIG. 8 is a view similar to FIG. 4 showing the FIG. 5 sleeve in the process of removal;

FIG. 9 is a top plan view of the FIG. 5 assembly in a relaxed condition of the sleeve;

FIG. 10 is a view similar to FIG. 9 showing opposing portions of the sleeve pressed together effecting head release; and FIG. 11 is a sectional view at an enlarged scale showing the locking lip of the sleeve relative to the head.

DETAILED DESCRIPTION OF THE INVENTION

Figure 1:
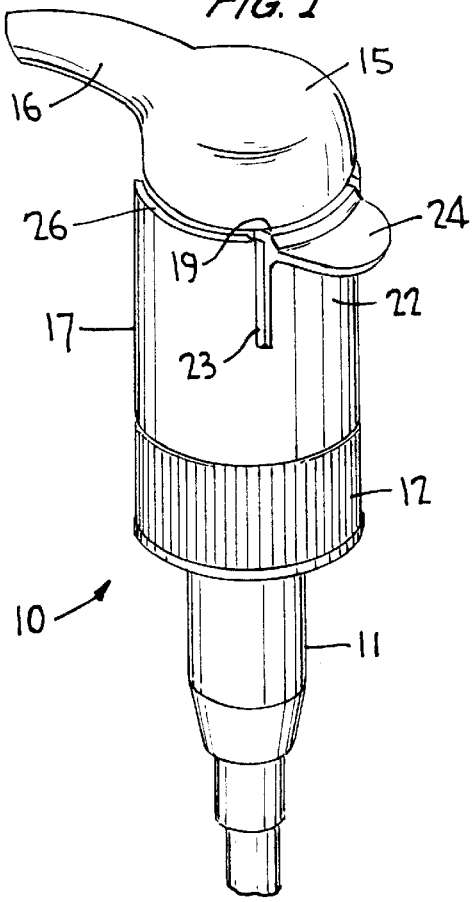
FIG. 1 is a perspective rear view of a pump dispenser incorporating one embodiment of the child-resistant feature of the invention which comprises a removable sleeve.
Figure 2:
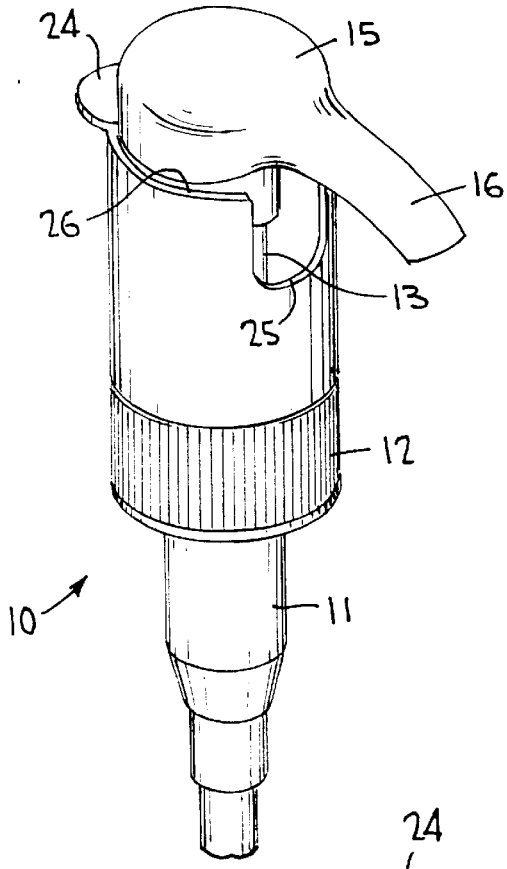
FIG. 2 is a perspective front view of FIG. 1.

Turning now to the drawings wherein like reference characters refer to like and corresponding parts throughout the several views, the liquid pump dispenser for which the invention is specifically adapted is generally designated 10 in FIGS. 1 to 4 and is described in more detail in U.S. Pat. No. 5,738,250, commonly owned herewith, the entirety of the disclosure thereof being incorporated herein by reference. The dispenser has a pump body which is includes a pump cylinder 11 extending into the interior of a container (not shown), the pump body being mounted to the neck of the container by a closure cap 12 in well-known manner. A pump piston (not shown) is mounted for reciprocation within cylinder 11, the piston having a hollow piston stem 13 extending through a central opening in a collar 14 on the cap. A plunger head 15 is fixedly mounted to the upper end of the piston stem, the head having a transversely extending discharge spout 16 through which product is dispensed upon reciprocation of the plunge relative to the closure cap as in a manner well known in this art.

In accordance with one embodiment of the invention, shown in FIGS. 1 to 4, a removable sleeve 17 is devised as a child-resistant feature the dispenser, i.e., preventing plunger reciprocation and thereby liquid discharge from the spout without first removing the sleeve from the pump body. As will be seen, sleeve removal requires essentially a three-step process comprising disparate steps which a child of tender years is generally incapable of performing. However the sleeve is capable of removal by an adult simply and quickly without undue exertion even by those having limited dexterity.

Sleeve 17 surrounds the piston stem of the pump body and engages top wall 18 of the closure cap. The sleeve has an integral lip 19 which engages an underside edge 21 of the plunger head for thereby locking the actuator against reciprocation. The lip is connected to a resilient flap 22 (FIG. 1) formed in the wall of the sleeve and defined by a pair of spaced slits 23 lying parallel to the central axis of the pump.

Figure 3:
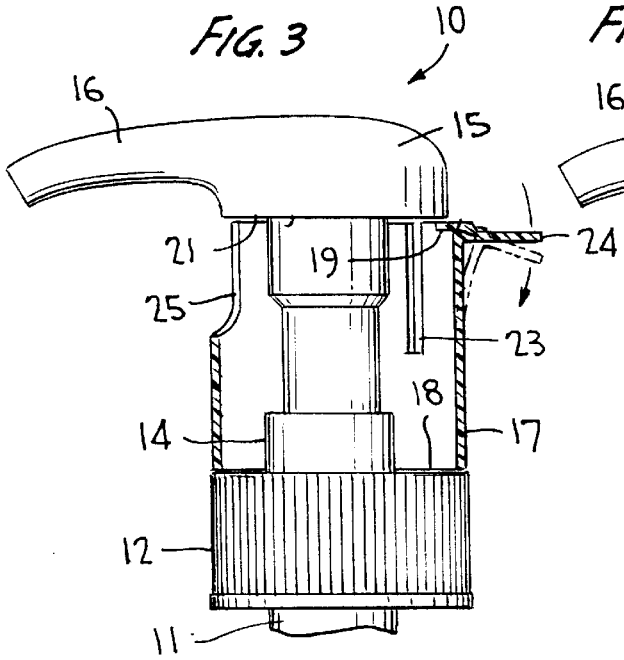
FIG. 3 is a side elevational view of the FIG. 1 assembly showing the sleeve in section.
Figure 4:
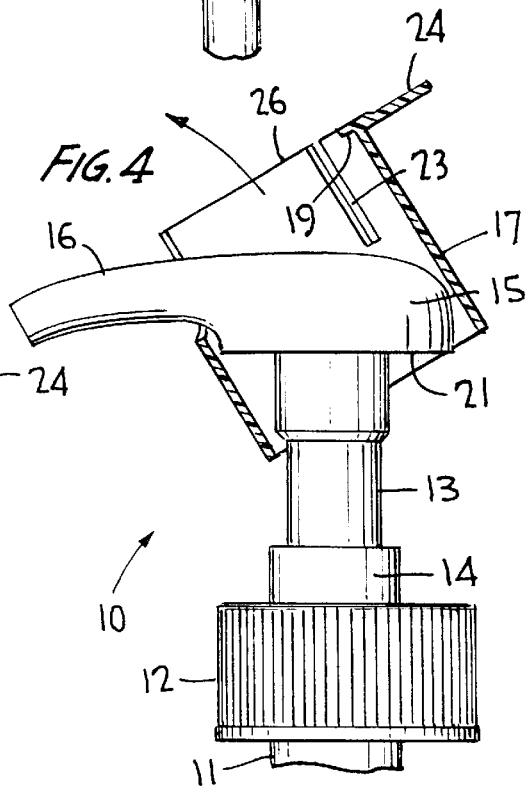
FIG. 4 is a view similar to FIG. 3 showing the sleeve in the process of removal.

A pull tab 24 extends radially outwardly from flap 22 for releasing the lip from the underside of the plunger head when depressed or pulled as illustrated in phantom outline and by the curved arrow in FIG. 3.

The sleeve is likewise rotatable about the central axis of the pump and has an opening in the form of a cutout 25 which opens toward the spout. The cutout is sufficiently deep to accommodate removal of sleeve 17 without interference as will now be described.

Before use, pump actuation and thus any inadvertent and unintended dispensing of liquid from the spout is prevented with sleeve 17 in place as it extends from top 18 of the closure cap surrounding plunger stem 13 and with lip 19 of the sleeve engaged beneath rim 21 of plunger head 15, as shown most clearly in FIGS. 1 and 3. The sleeve must first be removed entirely from the dispenser before the plunger can be actuated to dispense liquid.

Removable sleeve 17 is likewise rotatable about its central axis such that, in practice, notch 25 will likely be misaligned with discharge spout 16. To facilitate sleeve removal, the sleeve must be rotated to place cutout 25 into alignment with discharge spout 16, as shown in the drawings. Tab 24 is then depressed in the direction of the arrow shown in FIG. 3 whereupon resilient flap 22 permits lip 19 to be manually shifted into the phantom outline position of FIG. 3 out of engagement with the underside of the plunger head. While maintaining tab 24 depressed, the operator then pulls upwardly on the tab or grabs around the sleeve and moves it upwardly, such that the sleeve can be rotated in the direction of the arrow of FIG. 4 up and over the plunger head with spout 16 extending through cutout 25 until the sleeve is slid along the discharge spout and completely removed. Thus, a three-step operation is required for sleeve removal with each step being disparate and unable to be carried out by a child of tender years. The dispenser is accordingly rendered child-resistant in a manner requiring only a single part (the sleeve 17) without the need for any redesign or retooling of any existing pump part. The child-resistant feature according to the invention is thus efficient and inexpensive yet highly effective in thwarting pump actuation by a child.

It is to be pointed out that in those instances where the sleeve has its cutout already aligned with discharge spout 16, two disparate steps are required for sleeve removal, i.e., depression of tab 24, and while maintaining tab depressed, causing upward movement and rotation of the sleeve about the plunger head and a sliding along the discharge spout. Such two disparate steps are unlikely to be capable of being carried out by a child of tender years. And, it should be pointed out that in the event the child pulls down on finger tab 25 to release lip 19, with the sleeve having its cutout aligned with the spout as shown in the drawings, a downward depression on the head will cause the spout to nest within the cutout at the commencement of the piston stroke which is insufficient to effect the discharge of any product through the spout. And, should the child figure out how to depress tab 24 with the sleeve having its cutout misaligned with the discharge spout, any attempt to depress the plunger head will be resisted by upper edge 26 of the sleeve as the underside of the spout bears thereagainst.

A child-resistant liquid pump dispenser is generally designated 27 in accordance with another embodiment shown in FIGS. 5 to 11. The pump dispenser is identical to that shown in FIGS. 1 to 4 such that like parts will be identified by like reference numerals. The only difference from the FIG. 1 embodiment is sleeve 28 having a slightly different type of plunger lock-up release. The sleeve 28 nevertheless has the same cutout 25, and extends about piston stem 13 as it engages top wall 18 of the closure cap at one end of the sleeve with a lip 29 at or near an upper end of the sleeve engaging an underside of the plunger head as clearly shown in FIGS. 5, 6 and 9 to 11. Upper regions or sections 31 at opposed sides of the sleeve with lip 29 located therebetween are generally in the form of outwardly flared sections as shown in FIGS. 5 to 7.

In operation, depression of the plunger head is immobilized with the sleeve 28 surrounding the pump as in the manner shown in FIGS. 5, 6. Lip 29 underlies lower edge 21 of the plunger head such that with the lower edge of the sleeve bearing against top wall 18 of the closure cap, pump actuation is prevented unless and until the sleeve is removed from the a dispenser. Again, in most instances cutout 25 of the sleeve will not be aligned with spout 16 such that it will be necessary to first align the cutout with the spout by rotating the sleeve about its central axis. The opposing side walls 31 of the sleeve must then be pressed together in the direction of the arrows shown in FIG. 10 which cause the upper region 32 of the sleeve to shift outwardly away from the head in the direction of the arrow of FIG. 10 and as shown in FIG. 11 as region 32 shifts from its solid outline position to its phantom outline position. Lip 29 connected to region 32 is thereby caused to shift outwardly out of engagement with the underside of the plunger head. While inward finger force is applied in the direction of the arrows of FIG. 10, the sleeve is lifted upwardly by the operator and is shifted in the direction of the arrow of FIG. 8 around the plunger head, whereupon spout 16 extends through the cutout 25. The sleeve can then be slid along the spout until it is completely removed.

Again, the liquid dispenser is rendered child-resistant according to the FIGS. 5 to 11 embodiment by the provision of a single part (sleeve 28). There is no need to redesign or remold any existing pump dispenser part thereby saving costs in that effort alone. The upper regions of the sleeve only need be squeezed together to release lip engagement whereafter the sleeve can be removed as aforedescribed. It can be seen that a child of tender years is incapable of carrying out three different steps, or even two different steps in the event the sleeve is already aligned with its cutout directly beneath spout 16.

Obviously, many modifications and variations of the present invention are made possible in the light of the above teachings. For, example, the child-resistant feature offered by sleeve 17, 28 or the equivalent, is equally adaptable to other liquid dispensers than that described herein, without departing from the scope of the invention. It is therefore to be understood that within the scope of the appended claims the invention may be practiced otherwise than as specifically described.

What is claimed is:

1. A liquid dispenser comprising, a dispenser body, a closure cap for mounting the body on a container of liquid to be dispensed, the body including a manually reciprocable pump actuator having a dispenser head with a discharge spout, a rotatable sleeve surrounding the actuator between the head and a top wall of the closure, the sleeve having an opening permitting sleeve removal in only one rotative position thereof relative to the spout, manually releasable lock means on the sleeve engaging an underside of the head for immobilizing reciprocation of the actuator, and manually operable means on the sleeve to release the lock means to facilitate sleeve removal from the actuator upon alignment of the sleeve opening with the spout.

2. The dispenser according to claim 1, wherein the lock means comprises an inwardly extending lip at an upper end of the sleeve.

3. The dispenser according to claim 2, wherein the lip is located on the release means comprising a resilient flap formed in the sleeve.

4. The dispenser according to claim 3, wherein the flap comprises a wall of the sleeve defined by a pair of spaced slits.

5. The dispenser according to claim 3, wherein the flap has an outwardly extending pull tab for manually releasing the lip.

6. The dispenser according to claim 1, wherein the sleeve opening comprises a cutout opening toward the spout.

7. The dispenser according to claim 2, wherein opposing portions of the wall of the sleeve adjacent the dispenser head are spaced outwardly of opposing sides of the head and comprise the release means, the lip being located at an area between the opposing portions and being released from beneath the head when the portions are pressed together.

8. A liquid dispenser comprising, a dispenser body which includes a manually reciprocable pump plunger having a plunger head with a transversely extending spout mounted on a plunger stem, a closure cap for mounting the body on a container of liquid to be dispensed, removable means surrounding the stem for immobilizing plunger reciprocation, the removable means comprising a sleeve engaging a top wall of the closure and having at least one lip engaging an underside of the head, the lip being resiliently connected to the sleeve for manual release from the underside of the head, and an opening in the sleeve through which the spout extends upon sleeve removal.

9. The dispenser according to claim 8, wherein the lip is connected to a resilient flap formed in the wall of the sleeve, a pull tab on the flap for manually releasing the lip.

10. The dispenser according to claim 8, wherein the opening comprises a cutout opening toward the spout.

11. The dispenser comprising, a dispenser body which includes a manually reciprocable pump plunger having a plunger head with a transversely extending spout mounted on a plunger stem, a closure cap for mounting the body on a container of liquid to be dispensed, removable means surrounding the stem for immobilizing plunger reciprocation, the removable means comprising a sleeve engaging a top wall of the closure and having at least one lip engaging an underside of the head, an upper end of the sleeve being oval-shaped with opposing portions of the wall of the sleeve extending outwardly away from the head, the portions when pressed together effecting a release of the lip from the head.

12. The dispenser according to claim 11, wherein each of the opposing portions comprises an outwardly flared wall section.

* * * * *